US006363666B1

(12) United States Patent
Kandin

(10) Patent No.: US 6,363,666 B1
(45) Date of Patent: Apr. 2, 2002

(54) SAFETY DEVICE FOR PREVENTING A SKYLIGHT FROM BEING OPENED FROM OUTSIDE

(76) Inventor: Patrice Kandin, 19 Cours des Alpes, Meyrargues (FR), F-13650

( * ) Notice: Subject to any disclaimer, the term of this patent is extended or adjusted under 35 U.S.C. 154(b) by 0 days.

(21) Appl. No.: 09/486,099

(22) PCT Filed: Aug. 19, 1998

(86) PCT No.: PCT/FR98/01819

§ 371 Date: Feb. 22, 2000

§ 102(e) Date: Feb. 22, 2000

(87) PCT Pub. No.: WO99/10610

PCT Pub. Date: Mar. 4, 1999

(30) Foreign Application Priority Data

Aug. 22, 1997 (FR) ..... 97/10766
Oct. 9, 1997 (FR) ..... 97/12853

(51) Int. Cl.[7] ..... E04B 7/18

(52) U.S. Cl. ..... 52/200; 52/200; 52/302.4; 52/72; 52/1; 49/31; 49/65; 49/104; 49/108; 49/114; 49/357; 49/371

(58) Field of Search ..... 52/200, 72, 1, 52/302.4; 49/31, 65, 104, 108, 114, 357, 371

(56) References Cited

U.S. PATENT DOCUMENTS 3,350,819 A * 11/1967 Polidoro et al. ..... 52/1
4,106,399 A * 8/1978 Lawrence, Jr. ..... 98/2.14
4,164,106 A * 8/1979 Klosz ..... 52/72
4,480,406 A * 11/1984 Frank ..... 49/153
4,616,560 A * 10/1986 Esposito ..... 98/42.02
4,862,657 A * 9/1989 Jentoft et al. ..... 52/200
5,062,247 A * 11/1991 Dittmer ..... 52/200
6,009,929 A * 1/2000 Linderman et al. ..... 160/104
6,155,008 A * 12/2000 McKee ..... 52/198

OTHER PUBLICATIONS

English translation of International Preliminary Examination Report dated Jun. 16, 1999, 4 pp.

* cited by examiner

*Primary Examiner*—Carl D. Friedman
*Assistant Examiner*—Chi Nguyen
(74) *Attorney, Agent, or Firm*—Cohen, Pontani, Lieberman & Pavane

(57) ABSTRACT

The invention relates to a device for preventing insertion from the outside of instruments that could pivot the control bar situated on the inside of the skylight. The device is constituted by a box and two narrow strips positioned in an offset manner so as to form a baffle preventing any instrument being inserted while leaving a free passage for ventilation air. Spacers serve to stiffen the assembly. A cap protects the control lever for opening the lock of the skylight, and a fork enables the latch existing on the skylight to be moved.

24 Claims, 4 Drawing Sheets

FIG. 4
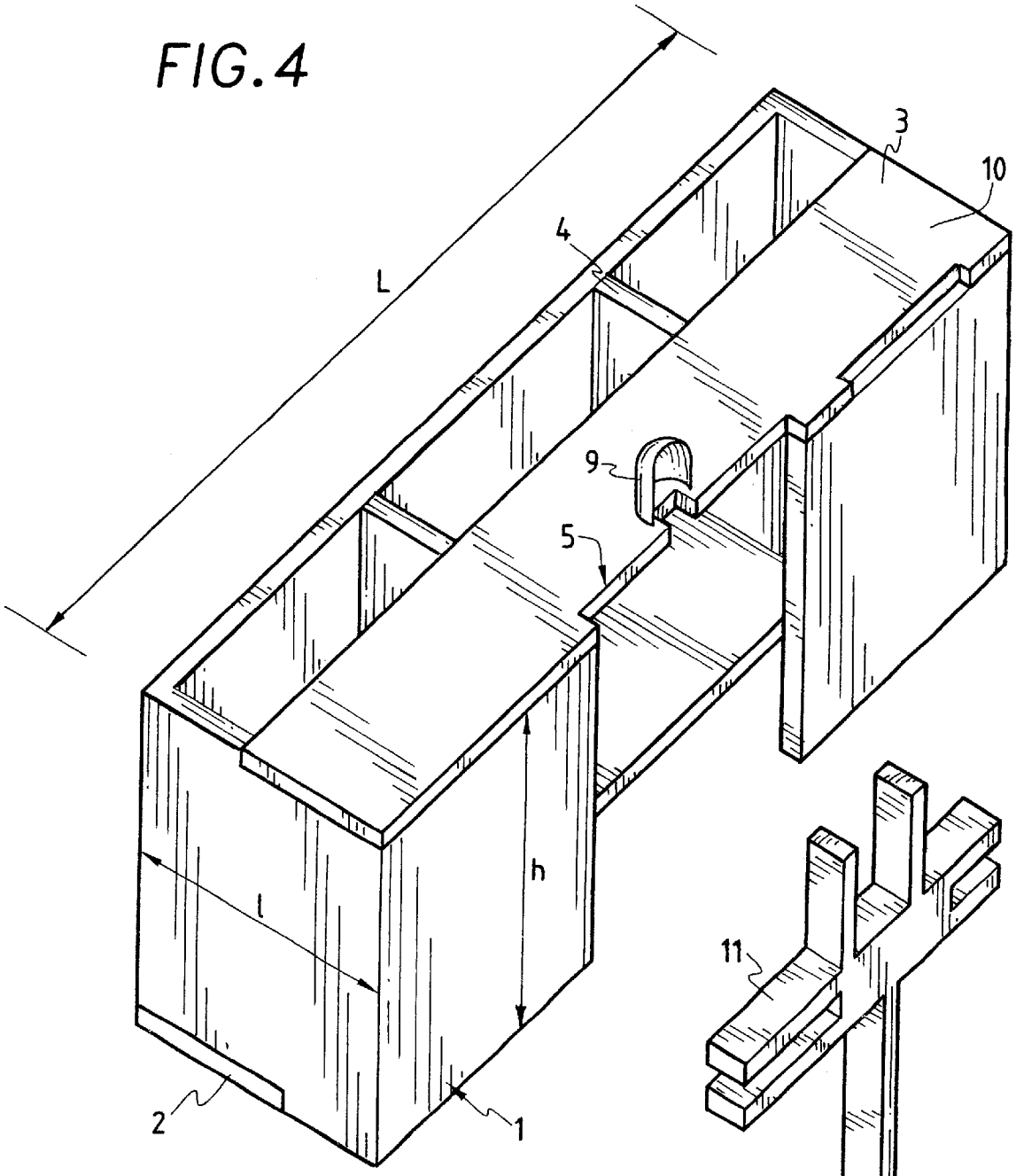
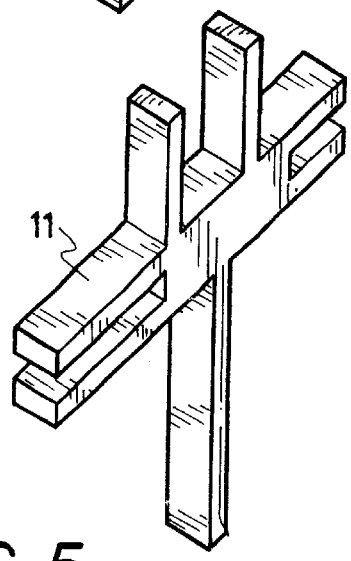
FIG. 5

SAFETY DEVICE FOR PREVENTING A SKYLIGHT FROM BEING OPENED FROM OUTSIDE

BACKGROUND OF THE INVENTION

1. Field of the Invention

The present invention relates to a safety device for preventing a skylight from being opened from the outside. The skylight has a control bar that is accessible through a ventilation opening for putting the inside and the outside of said skylight into communication, and the device prevents such access without preventing such ventilation from taking place.

2. Description of the Related Art

Conventionally, such a skylight is opened from the inside by means of the control bar which serves to lock the skylight in the closed position and as a ventilation flap when in a half-open or half-closed position. Since one of the purposes of a skylight is also to protect a house by being opened only from the inside, it can be said that until now this object has not been fulfilled by certain skylights which can be opened from the outside since it is possible to actuate the control bar by inserting an instrument from the outside through the ventilation opening to pivot said control bar, and thus open the skylight.

SUMMARY OF THE INVENTION

The object of the present invention is thus to remedy that problem: for this purpose, the device of the invention includes at least two overlapping strips whose areas are smaller than the transverse sections of the opening that they close in part, so that no rigid instrument can be slid from the outside to the control bar, while leaving an unobstructed passage for ventilation air. These strips are preferably situated in the planes of the transverse sections defining the outside and inside faces of the volume of the ventilation opening.

In a preferred embodiment, the two strips have width dimensions smaller than those of the transverse sections extending along the opening side of the skylight, the strips being positioned in an offset manner so as to form a battle; the offset position does not prevent air from flowing, so the ventilation function of the skylight can continue to be used.

In particularly embodiments of the invention:

the two strips cover the transverse sections of the opening in full and they are provided with apertures of any shape but in a manner that is offset without vertical alignment between the two strips;

the strips can also be constituted by perforated metal sheets or small-mesh netting covering the transverse sections in full;

the device can be used with one or more cutouts depending on the size of the skylight, each cutout being formed in the strip situated adjacent to the closure mechanism(s) existing in the skylight so as to allow the mechanism(s) to pass therethrough, i.e. to the outside;

depending on the length of the strips, two or more spacers can interconnect the strips so as to reinforce the device; and at least one cap of shape suitable for protecting the skylight closure mechanism such as a lever for controlling its lock, can be placed in register with each cutout formed in the strip for passing the mechanism; the cap(s) is/are secured either to the strip situated on the outside of the skylight or to the closure mechanism disposed o the moving frame of the skylight itself.

A cutout can also be made in the strip situated on the outside of the skylight so as to receive a fork that serves to actuate any existing bolt serving to hold the skylight ajar; the sides forming the slider of the fork are longer than the dimensions of the cutout so that in all positions of the fork the opening of the cutout receiving said fork is covered so as to leave no through passage.

In a preferred embodiment of the invention, the strips co-operate with at least two link spacers to constitute a box whose two transverse sections are partially closed by the strips and which is thus removable; in another embodiment, the strips can be made directly and/or machined while the ventilation opening is being made, thus forming an integral portion of the moving frame of the skylight, or they can be fixed thereto.

To reinforce the baffle effect between the offset openings in the strips that partially close the base areas of the ventilation opening, at least one third strip can be interposed between them in the middle of the box so as to increase the difficulty of inserting an instrument.

The result is a novel safety device preventing skylights that have a control bar placed in register with a ventilation opening from being opened from the outside. The device of the invention can be added in the form of a prefabricated box to an already-existing skylight without any need for the user to modify the box, or it can be fitted to a new skylight so as to be directly integrated in the moving frame of the skylight.

BRIEF DESCRIPTION OF THE DRAWINGS

The accompanying drawings show an embodiment of the invention, but other embodiments are possible within the ambit of the scope of the extent of the invention:

FIG. 4 a perspective view of the device of the invention as shown in FIGS. 1 and 2.

FIG. 5 is a perspective view of a fork forming a portion of the FIG. 4 device and compatible with the cutout 10 shown in that figure.

DETAILED DESCRIPTION OF THE PRESENTLY PREFERRED EMBODIMENTS

Figure 1:
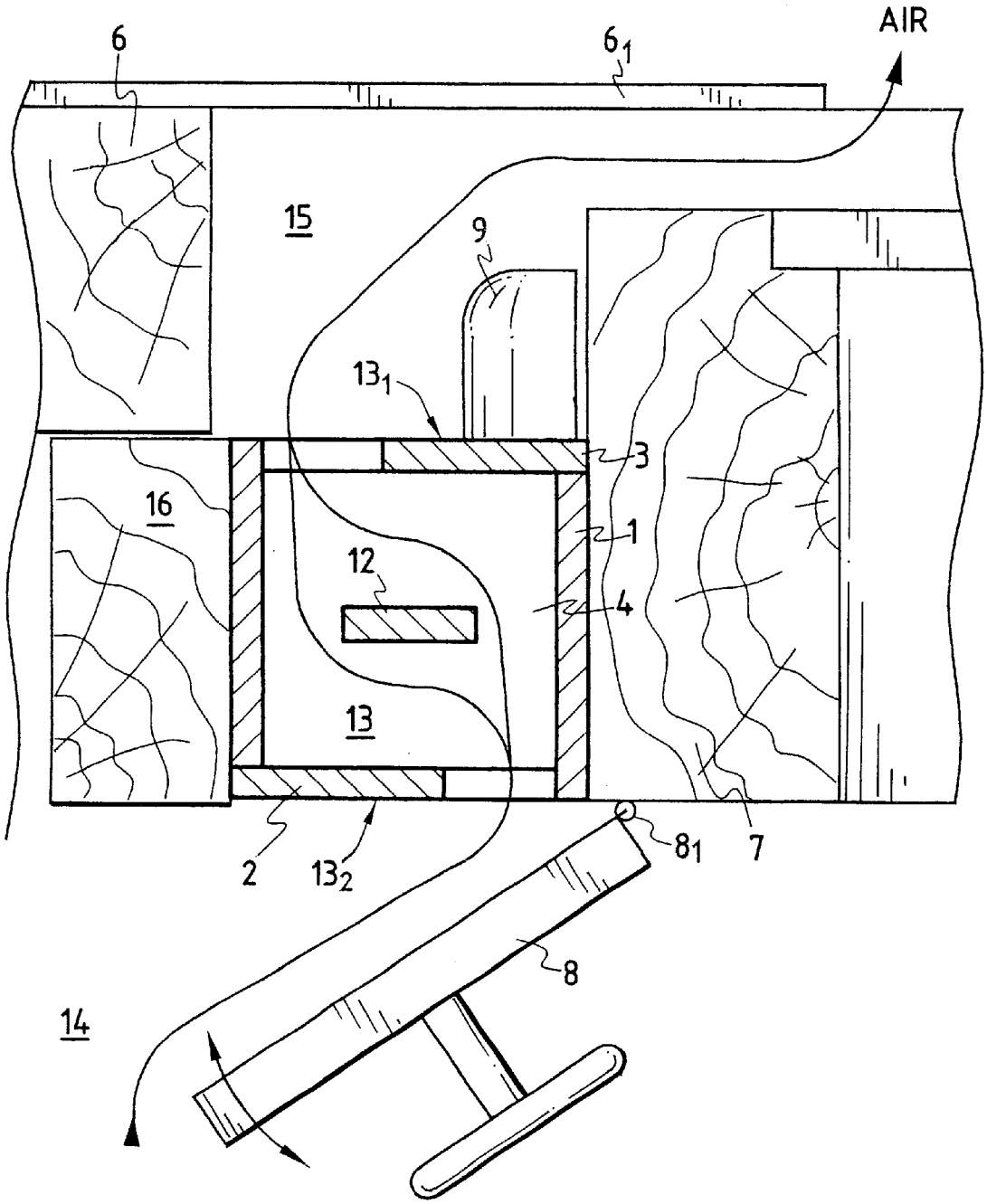
FIG. 1 is a section on AA of FIG. 2 showing an embodiment of the device of the invention in the form of a removable box inserted in the ventilation opening of the moving frame of a skylight, part of which is shown using fine lines, which skylight is of the general kind shown in FIG. 6.
Figure 6:
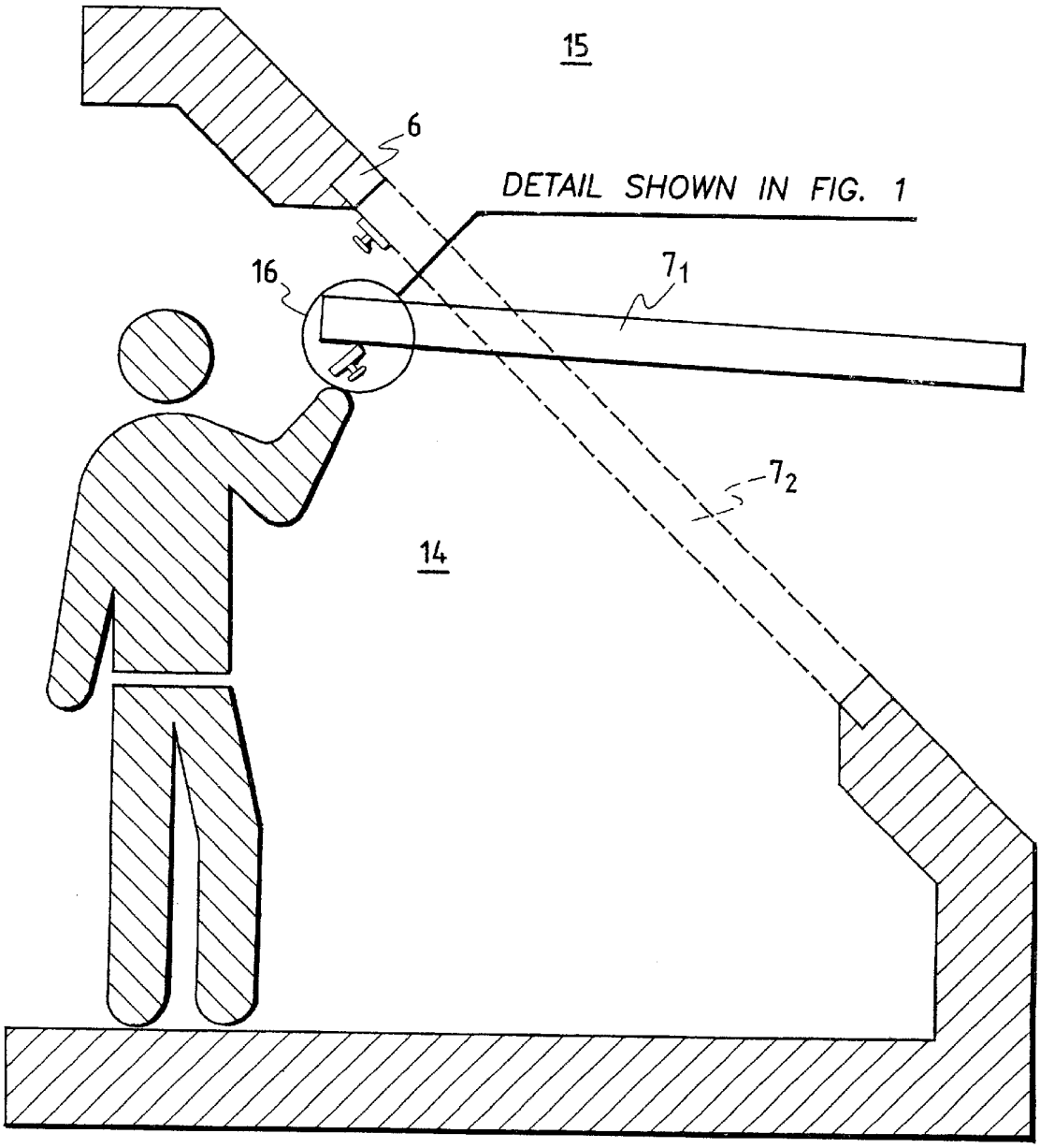
FIG. 6 is a side view in section of a skylight showing the location of the larger-scale detail of FIG. 1, with the skylight being shown in continuous lines its open position and in dashed lines in its closed position.

Referring to FIGS. 1 and 6, the skylight comprises, in conventional manner, a fixed portion 6 secured to the roof, a moving frame 7 that can move between any open position $\mathbf{7}_1$ and the closed position $\mathbf{7}_2$, and an inside control bar 8 which is generally situated at the tope of the moving frame 7 when the skylight is placed in a sloping roof as shown in FIG. 6.

The control bar 8 is placed in register with a ventilation opening 13 that puts the outside 15 and the inside 14 of the skylight into fluid communication: the control bar 8 is hinged about an axis, $\mathbf{8}_1$, and, since its length is not less than the width of the area occupied by the ventilation opening 13, the bar enables the ventilation opening (which opens out to the inside 14 of the skylight) to be closed when the bar is pressed against the inside face $\mathbf{13}_2$ of the opening; in a half-open position, the control bar 8 is moved away from the opening, thus making ventilation possible while still keeping the skylight closed; and in a fully-tilted, opening position the control bar allows the skylight to be completely opened as shown in continuous lines in FIG. 6.

In accordance with the invention, the device comprises a box 1 made of steel or of plastics if it is made by molding, the box being in the form of a rectangular parallelepiped whose two faces 2 and 3 that form its tope and bottom walls partially close the transverse sections $\mathbf{13}_1$ and $\mathbf{13}_2$ of the opening 13 of the skylight 7. For this purpose, and in the embodiments shown in FIGS. 1, 2, and 4, the walls receive respective strips, each smaller in width than the ventilation opening 13 in the skylight 7 and placed lengthwise along the opening edge 16 thereof. The two strips 2, 3 are then disposed in an offset overlapping manner so as to form a baffle against instruments for opening from the outside. The strips 2, 3 are preferably situated in the planes of the transverse sections $\mathbf{13}_1$, $\mathbf{13}_2$ that define the outside and inside faces of the volume of the ventilation opening 13, however in other embodiments, the strips can be set back from these faces.

A third strip 12 can be interposed in the middle of the box 1 between said two strips 2 and 3, and various spacers 4 along the length direction of the box serve to stiffen the assembly.

Figure 2:
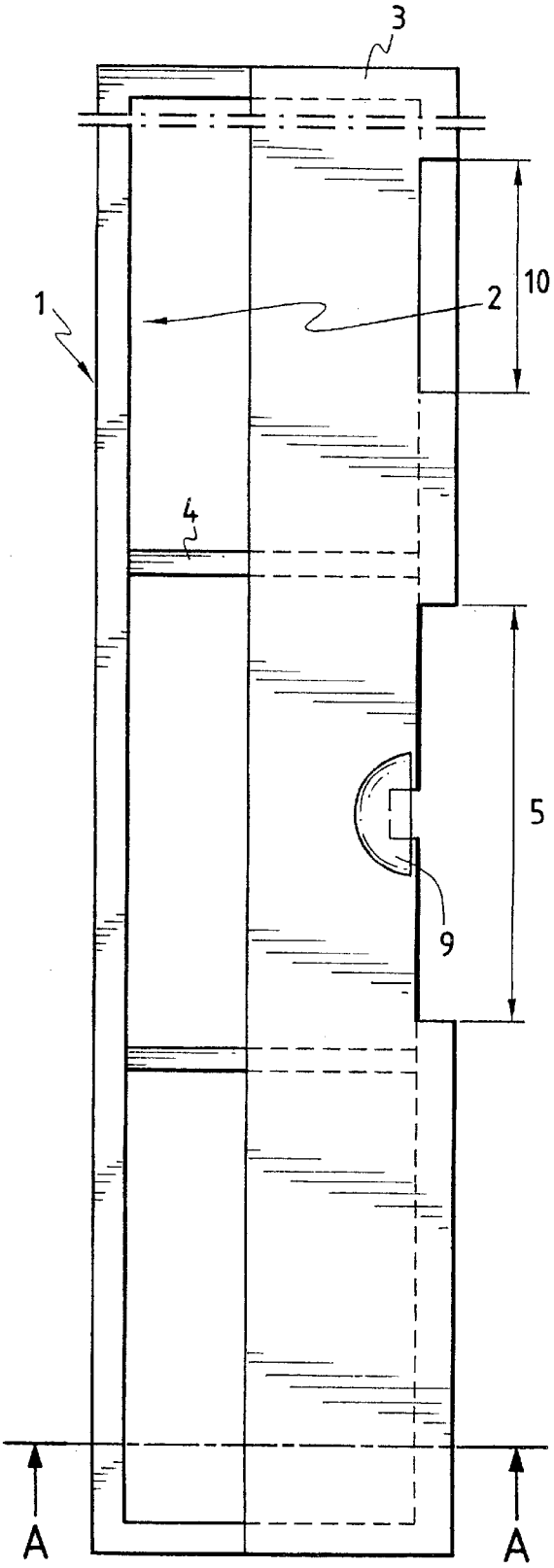
FIG. 2 is a plan view of the FIG. 1 device.
Figure 3:
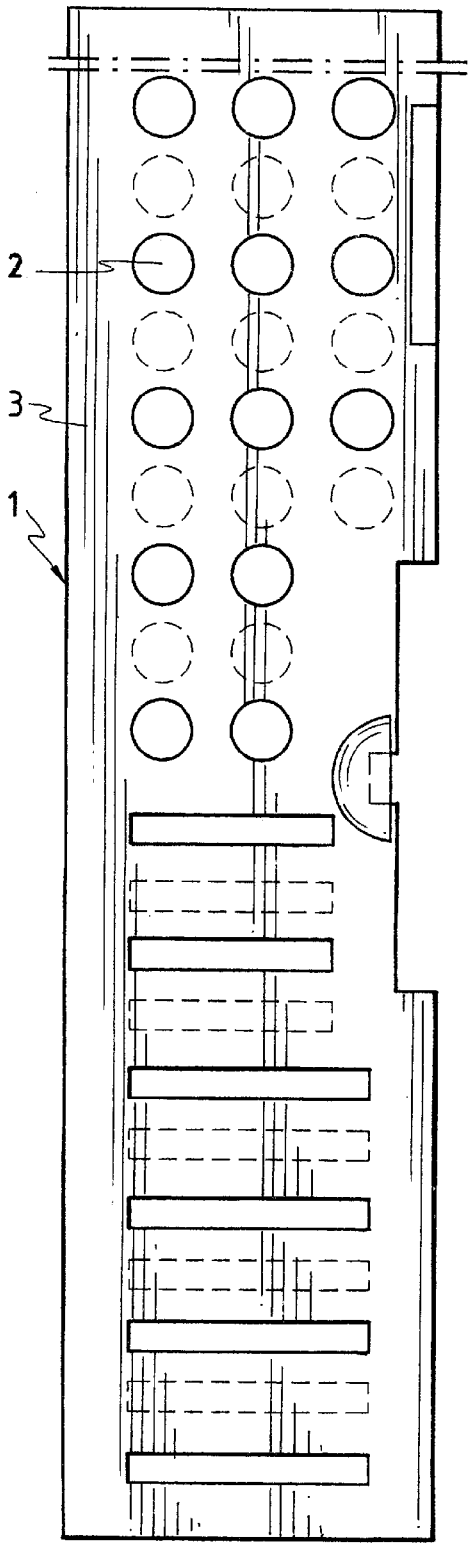
FIG. 3 is a plan view of a variant of the device.

Depending on the size of the skylight 6, 7, 8, one or two cutouts 5 are machined at least in the strip 3 of FIGS. 2 and 3 so as to allow the closure mechanism(s) of the skylight to pass through. One or two caps 9 serve to protect the closure mechanisms of the skylight, said caps being placed, in the present embodiment, on the strip 3 and being situated on the outside 15 of the skylight, but they could equally well be secured to the closure mechanism for the moving frame 7 of the skylight.

In the variant shown in FIG. 3, said two strips 2 and 3 can close the box 1 completely and they can be pierced by circular or oval or other holes, but with the holes always being in positions that are mutually offset and not in vertical alignment.

Referring to FIGS. 4 and 5, a cutout 10 machined in the strip 3 so as to receive a fork 11 enables the existing latch of the skylight to be actuated. The sides forming the slider of the fork are longer and also wider than the machined cutout 10 so that in all positions of the fork, the cutout 10 is covered so as to leave no through passage.

By way of non-limiting example, the box 1 can have dimensions of about 30 mm for its width "1", a height "h" of about 20 mm to 30 mm, and a length "L" which is a function of the skylight that is to be fitted, e.g. 500 mm to 1400 mm. If the skylight is motor-driven, the user or the installer can subdivide the device into three pieces by using marks made on the box: the central piece corresponding to the location of the motor-driven mechanism is then discarded, while the two remaining end pieces are reused for the same function.

In an embodiment using a removable box as shown in the accompanying figures, such boxes are fixed in the moving portion 7 of the skylight by any appropriate means such as screws capable of withstanding thrust from an outside instrument so as to prevent the box being moved and thus protect the inside control bar 8. By way of example, such screws can be screwed through the removable box and the portion 16 of the moving frame.

What is claimed is:

1. A device adapted to be used for preventing a skylight from being opened from the outside of a skylight, the skylight including an inside control bar disposed in register with a ventilation opening for putting the inside and the outside of the skylight in fluid communication, the skylight further including a closure mechanism and a moving frame, the device comprising at least two strips whose areas arc smaller than transverse sections of said ventilation opening which they close partially in such a manner that no rigid instruments can be slid from the outside towards the inside control bar, while leaving unimpeded a passage for fluid communication through said passage.

2. A device according to claim 1, wherein said at least two strips are of width smaller than the transverse sections, said strips being positioned in offset manner to form a baffle.

3. A device according to claim 1, wherein the at least two strips cover the transverse sections of the opening completely, and are provided with apertures that are disposed in offset and non-vertically aligned manner between said at least two strips.

4. A device according to claim 1 further comprising at least a third strip interposed between the at least two strips.

5. A device according to claim 1 wherein, depending on the size of the skylight, at least one cutout is formed at least in the strip disposed adjacent to the closure mechanism of the skylight so as to allow the closure mechanism to pass therethrough.

6. A device according to claim 5, further comprising a cap at said at least one cutout, the shape of the cap being machined to protect the closure mechanism of the skylight.

7. A device according to claim 6, wherein said cap is secured to the strip situated towards the outside of the skylight.

8. A device according to claim 6, wherein said cap is secured to the mechanism for closing the moving frame of the skylight.

9. A device according to claim 1, wherein at least one cutout is formed in the strip situated on the outside of the skylight so as to receive a fork serving to actuate an existing latch.

10. A device according to claim 1 further comprising at least two link spacers, wherein said at least two strips co-operate with the at least two link spacers to form a box wherein said transverse sections are closed in part by said at least two strips.

11. A device adapted to be used for preventing a skylight from being opened from the outside of the skylight, the skylight being of the type comprising a fixed portion, a moving frame which is mounted to move with respect to said fixed portion between an open position and a closed position, a ventilation opening for putting the inside and the outside of the skylight in fluid communication, said ventilation opening extending at least in part in said moving frame, and an inside control bar adjacent to said ventilation opening for locking the moving frame in the closed position and for forming a ventilation flap for the ventilation opening, said device comprising at least two strips disposed in respective transverse sections of said ventilation opening, said strips having areas which partially close said transverse sections so that a rigid instrument cannot be slid from outside the skylight toward the inside control bar, while leaving unimpeded a passage for fluid communication through said ventilation opening.

12. A device as in claim 11 wherein said strips each have a width which is smaller than the width of the respective transverse section, said strips overlapping each other in an offset manner so as to form a baffle against inserting said instrument through said ventilation opening from outside said skylight.

13. A device as in claim 12 wherein said strips cover said transverse sections, each said strip having apertures which are not aligned with the apertures of the other strip.

14. A device as in claim 11 further comprising a box which is fixed to said moving frame, said box having a top face and a bottom face which form said transverse sections.

15. A device as in claim 12 further comprising a third strip disposed between said strips at said inside and outside faces.

16. A skylight comprising a fixed portion, a moving frame which is mounted to move with respect to said fixed portion between an open position and a closed position, a ventilation opening for putting the inside and the outside of the skylight in fluid communication, said ventilation opening extending at least in part in said moving frame, an inside control bar adjacent to said ventilation opening for locking the moving frame in the closed position and for forming a ventilation flap for the ventilation opening, and at least two strips disposed in respective transverse sections of said ventilation opening, said strips having areas which partially close said transverse sections so that a rigid instrument cannot be slid from outside the skylight toward the inside control bar, while leaving unimpeded a passage for fluid communication through said ventilation opening.

17. A skylight as in claim 16 wherein said strips each have a width which is smaller than the width of the respective transverse section, said strips overlapping each other in an offset manner so as to form a baffle against inserting said instrument through said ventilation opening from outside said skylight.

18. A skylight as in claim 17 wherein said strips cover said transverse sections, each said strip having apertures which are not aligned with the apertures of the other strip.

19. A skylight as in claim 18 further comprising a box which is fixed to said moving frame, said box having a top face and a bottom face which form said transverse sections.

20. A skylight as in claim 19 further comprising a third strip disposed between said strips at said inside and outside faces.

21. A skylight as in claim 16 further comprising at least one cutout in at least one of said strips, said cutout being provided to allow a closure mechanism to pass therethrough.

22. A skylight as in claim 21 further comprising a cap fitted over said cutout to protect said closure mechanism.

23. A skylight as in claim 22 wherein said cap is secured to one of said strips.

24. A skylight as in claim 16 further comprising at least one cutout in at least one of said strips, and a slidable fork received in said cutout, said fork serving to actuate a latch.

* * * * *